United States Patent [19]

Klein et al.

[11] Patent Number: 4,979,239

[45] Date of Patent: Dec. 25, 1990

[54] SUPPORT STRUCTURE FOR WALL-MOUNTED SANITARY APPARATUS, AND SUPPORTING UPRIGHTS THEREFOR

[75] Inventors: Jean-Pierre Klein, Clamart; Claude Gabel, Claye Souilly; Marc Funten, Metry Le Neuf; André Rivaud, Vaires Sur Marne, all of France

[73] Assignee: Placoplatre, Rueil-Malmaison, France

[21] Appl. No.: 390,399

[22] Filed: Aug. 7, 1989

[51] Int. Cl.[5] ..... E03D 11/00

[52] U.S. Cl. ..... 4/252 R

[58] Field of Search ..... 4/191, 252 R; 285/64; 52/35; 137/360; 248/57

[56] References Cited

U.S. PATENT DOCUMENTS

| | | | |
|---|---|---|---|
| 1,946,140 | 2/1934 | Heinkel | 4/252 R |
| 2,661,677 | 12/1953 | Lingelbach | 248/57 X |
| 2,932,037 | 4/1960 | Manas | 4/252 R |
| 2,942,277 | 6/1960 | Manas | 4/252 R |
| 3,014,223 | 12/1961 | Pope | 4/252 R |
| 3,129,437 | 4/1964 | McClenahan | 4/252 R |
| 3,251,073 | 5/1966 | Rawson | 4/252 R |
| 3,278,950 | 10/1966 | Hutchins | 4/252 R |
| 3,286,280 | 11/1966 | Duggan | 4/252 R |
| 3,323,143 | 6/1967 | Pope | 4/252 R |
| 3,686,695 | 8/1972 | Mielback et al. | 4/252 R |
| 3,732,582 | 5/1973 | Mielback et al. | 4/252 R |
| 4,058,859 | 11/1977 | Arrowood | 4/252 R |
| 4,716,925 | 1/1988 | Prather | 4/191 X |

FOREIGN PATENT DOCUMENTS

| | | | |
|---|---|---|---|
| 2603361 | 8/1977 | Fed. Rep. of Germany | 52/35 |
| 2809135 | 9/1979 | Fed. Rep. of Germany | 4/252 R |
| 3410499 | 8/1985 | Fed. Rep. of Germany . | |
| 3617617 | 11/1987 | Fed. Rep. of Germany | 4/252 R |
| 1583098 | 10/1969 | France . | |
| 1586181 | 2/1970 | France . | |
| 597802 | 9/1959 | Italy | 4/252 R |
| 462558 | 10/1968 | Switzerland . | |

*Primary Examiner*—Henry J. Recla
*Assistant Examiner*—Robert M. Fetsuga
*Attorney, Agent, or Firm*—Charles E. Brown; Charles A. Brown

[57] ABSTRACT

A support structure for sanitary apparatus to be wall-mounted on a partition wall incorporating an internal framework.

In accordance with the invention the support structure comprises, joined to each other in one piece by two legs (31), two crossmembers (32, 33) at least one of which comprises at least one pair of holes (34) disposed symmetrically to each other on either side of a median vertical axis (M) and adapted to fasten the sanitary apparatus (11) concerned and locating means adapted to enable fastening to it at a given location of at least one pipe or the like (23, 24, 25, 26) adapted to serve the sanitary apparatus (11).

Application to the wall-mounting of any kind of sanitary apparatus.

16 Claims, 2 Drawing Sheets

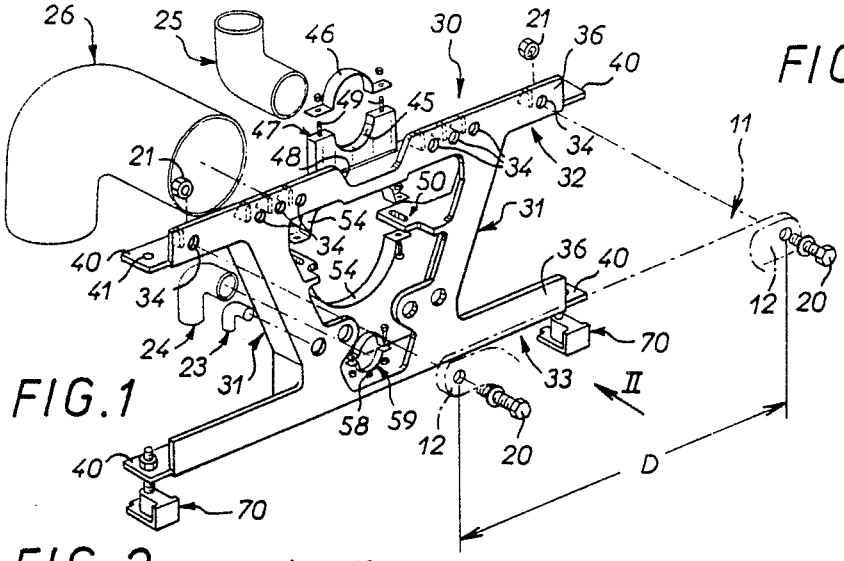
FIG.1
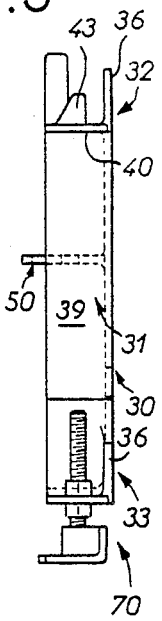
FIG.3
FIG.2
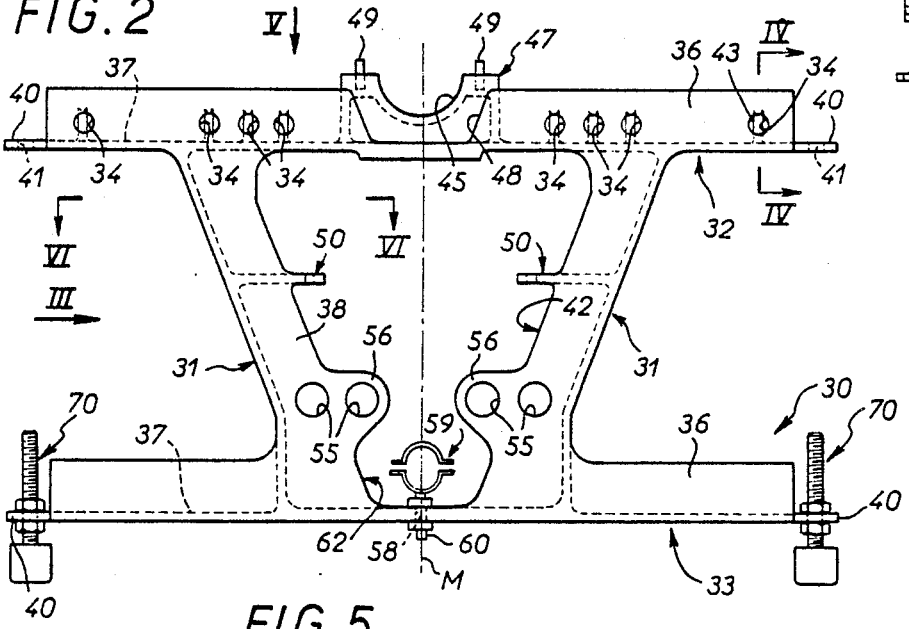
FIG.5
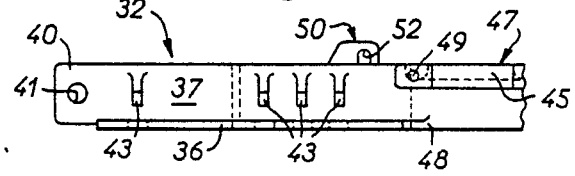
FIG.6
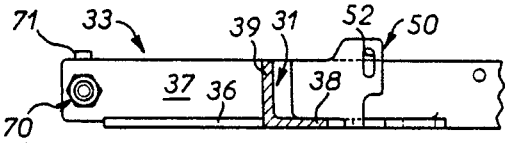
FIG.4
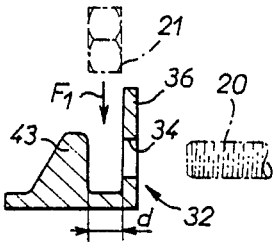

SUPPORT STRUCTURE FOR WALL-MOUNTED SANITARY APPARATUS, AND SUPPORTING UPRIGHTS THEREFOR

The present invention is generally concerned with wall-mounted sanitary apparatus such as, for example, washbasins, bidets and WC bowls.

It is known that in some places, and in public places in particular, it is increasingly common to mount at least some sanitary apparatus on the wall instead of providing the sanitary apparatus with a base whereby it is directly supported by the floor, both to facilitate cleaning the floor under it and to limit the depradations to which it may be subjected.

The present invention is more particularly directed to the case of wall-mounting on a hollow partition wall, that is to say a partition wall comprising a framework formed in practice of spaced uprights fitting at the bottom into a bottom rail on the floor and at the top into a top rail fixed to the ceiling, with cladding panels appropriately attached to the framework, in practice by screwing.

The mechanical strength of a framework of this kind enables sanitary apparatus to be wall-mounted to it.

However, this entails the use at an appropriate height and between two uprights of a framework of this kind or between two special uprights adjacent and appropriately attached to the latter, of a supporting structure specific to this purpose, and in France usually called a "chair".

There is a two-fold problem in realizing any such support structure.

Firstly, it is important that the system can cater for different sizes of sanitary apparatus, given that the dimensions of sanitary apparatus frequently vary depending on the nature and/or the source of the apparatus; secondly it is important that the system can allow for adjustment of the height of the sanitary apparatus fixed to it in this way.

Given these requirements, in practice a special support structure for each type of sanitary apparatus is usually provided, which goes against the principle of standardization and increases costs.

However, there has already been proposed a support structure adapted to fixing sanitary apparatus of different types. To enable the corresponding positional adjustments this support structure is formed of two legs which are adapted to bear directly on the floor, engaging in the corresponding bottom rail, and top and bottom crossmembers mounted on the legs in such a way as to be adjustable in height, the legs forming slideways for this purpose. The crossmembers themselves form slideways to accommodate the various dimensions of the sanitary apparatus to be attached.

In practice this implementation is somewhat complex and as the positional adjustments are not carried out in a positive way there remains some uncertainty as to the accuracy of these adjustments and as to them being maintained during manipulation to mount the apparatus.

Moreover, in an implementation of this kind there is no specific provision for attaching pipes or the like serving the sanitary apparatus concerned.

A general object of the present invention is a support structure free of these disadvantages and offering other advantages.

This support structure, which is thus adapted to wall-mounting of any sanitary apparatus, is generally characterized in a first aspect in that it comprises, joined one to the other in one piece by two legs, two crossmembers at least one of which comprises a pair of holes disposed symmetrically relative to each other on either side of a median vertical axis and adapted to attach the sanitary apparatus concerned and conjoint locating means adapted to enable attachment thereto at a specific location of at least one pipe or the like to serve the sanitary apparatus.

Thus in accordance with this first aspect of the invention the support structure is advantageously of monobloc construction, easy to manipulate and to use and adapted to procure positive and therefore secure positional adjustments.

From this point of view the upper crossmember of the support structure in accordance with the invention in practice comprises a plurality of pairs of holes to cater for all properly standardized dimensions of the various kinds of sanitary apparatus concerned.

The number of pairs of holes needed proves to be relatively small and so it would be redundant to substitute a slideway for them.

Thus in accordance with the invention a single part, advantageously of monobloc construction, with appropriately pre-formed holes is advantageously adapted to suit all sanitary apparatus likely to be used.

The support structure in accordance with the invention is further and advantageously adapted to fixing not only a sanitary apparatus of this kind, to be more precise the ceramic part thereof, but also fixing the pipes or the like serving it.

In a second aspect the support structure in accordance with the invention is further characterized in that two uprights are disposed at respective ends of its crossmembers to support it and said uprights each comprise two flanges by means of which they are adapted to bracket said ends, at least one of the flanges of each of said uprights comprising along its length a row of perforations forming a rack and at least one of the crossmembers of the support structure is engaged with the rack which both said uprights thus comprise, each end of a crossmember being for this purpose equipped with a cramps having a transversely projecting pin adapted to engage in any of the perforations in the rack.

This results in an advantageous saving of time during installation.

Installation is then a simple two-stage process.

Initially the uprights are flat, aligned with each other. The support structure fitted with its cramps is offered up slantwise relative to the uprights and, with a simple tilting movement to align it with the plane of the uprights, the pins of its cramps are inserted into their racks.

In the second stage the uprights are raised to the vertical position by pivoting around the pins of the cramps of the support structure, which causes their flanges to engage over the ends of the crossmembers of the support structure and so lock the latter in position.

In service, the pins of the cramps are subject to only a simple shear force, the tilting moment to which the entire support structure is subjected being resisted in a very simple way by the uprights with which it is engaged by virtue of the cramps, whether the uprights are uprights of the corresponding framework or special uprights adjoining and appropriately fixed to uprights of the framework.

Each of the cramps employed in this way preferably constitutes a screw-jack.

It is then advantageously possible to adjust finely the height at which the sanitary apparatus concerned is located, this adjustment being preceded by a coarse adjustment, that is by an appropriate choice of the perforations of the racks on the uprights with which the corresponding cramps are engaged.

The characteristics and advantages of the invention will emerge from the following description given by way of example with reference to the appended diagrammatic drawings in which:

FIG. 1 shows in darker outline a perspective view of a support structure in accordance with the invention and in lighter outline part of the sanitary apparatus to be fixed to it and pipes or the like serving the sanitary apparatus;

FIG. 2 is a view in elevation of this support structure as seen in the direction of the arrow II in FIG. 1;

FIG. 3 is a side view of it as seen in the direction of the arrow III in FIG. 2;

FIG. 4 is a partial view of it to a larger scale and in transverse cross-section on the line IV—IV in FIG. 2;

FIG. 5 is a partial view of it in elevation as seen in the direction of the arrow V in FIG. 2;

FIG. 6 is a partial view of it in longitudinal cross-section on the line VI—VI in FIG. 2;

As shown in the figures, the overall objective is to mount on a hollow partition wall comprising an internal framework 10 any form of sanitary apparatus 11, of which only the lugs 12 adapted to enable such fitting have been schematically represented in thinner chain-dotted outline in FIG. 1.

Figure 10:
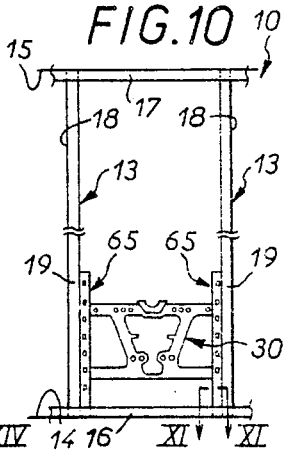
FIG. 10 is a view in elevation to a reduced scale showing one possible mode of use for the support structure in accordance with the invention.
Figure 11:
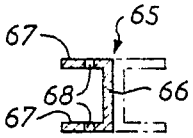
FIG. 11 is a view to a larger scale of one of the corresponding uprights in cross-section on the line XI—XI in FIG. 10.

In a manner that is known in itself and as diagrammatically shown in FIG. 10 the framework 10 of the hollow partition wall comprises spaced uprights 13 which extend from the floor 14 to the ceiling 15 and are inserted at the bottom in a bottom rail 16 fixed to the floor 14 and at the top in a top rail 17 fixed to the ceiling 15.

In a way that is also known in itself the uprights 13 are generally C-shape in transverse cross-section with a straight median part 18 and two lateral flanges 19 parallel to each other and substantially perpendicular to the median part 18.

Finally, and also in a way that is known in itself, the sanitary apparatus 11 concerned is fixed by means of bolts 20 adapted to cooperate with nuts 21 and depending on the nature of the sanitary apparatus 11 at least one conduit or the like must be provided to serve it, as schematically represented in thinner outline in FIG. 1.

In the case of a washbasin, for example, it is necessary to provide at least one water supply pipe 23, in practice two such pipes 23, one for cold water and the other for hot water, and a drain pipe 24.

In the case of a bidet it is likewise necessary to provide two water supply pipes 23 and a drain pipe 24 but the pipes 23 and the pipe 24 are obviously at different heights than those for a washbasin.

Finally, in the case of a toilet bowl it is necessary to provide at heights different from the foregoing heights a water supply pipe 25 to connect it to the corresponding cistern and a drain pipe 26.

These arrangements are well know in themselves and as they do not of themselves form any part of the present invention they will not be described in more detail here.

In accordance with the invention a support structure 30 is used to wall-mount the sanitary apparatus 11. It comprises, joined to one another in one piece by two legs 31, upper and lower crossmembers 32, 33 at least one of which, in practice the upper crossmember 32, comprises at least one pair of holes 34 disposed symmetrically to each other on either side of a median vertical axis M schematically represented in chain-dotted outline in FIG. 2 and adapted for fixing the sanitary apparatus 11. It conjointly comprises, by virtue of provisions to be described in more detail later, locating means adapted to enable the attachment to it at a given location of at least one pipe or the like such as the pipes 24, 26 or the pipes 23, 25 serving the sanitary apparatus 11.

Thus in accordance with the invention the support structure is a single monobloc unit.

It is cast in aluminum, for example.

In the embodiment shown, each of the crossmembers 32, 33, or at least its main part, is angle-iron shape with a vertical flange 36 and a horizontal flange 37.

The vertical flanges 36 of the upper crossmembers 32 and the lower crossmember 33 are coplanar.

Likewise, in the embodiment shown each of the legs 31 is angle-iron shape with a flange 38 disposed in the same plane as the flanges 36 of the crossmembers 32, 33, continuous with the latter, and a flange 39 perpendicular to the flange 38.

In the embodiment shown the flange 39 extends as far as the horizontal flange 37 of the lower crossmember 33.

These various arrangements are not imperative, however.

In the embodiment shown the crossmembers 32 and 33 are generally parallel to each other and the same length. For reasons that will emerge later each of their ends forms a lug 40 in which is a hole 41.

In practice the lugs 40 which the crossmembers 32, 33 thus comprise are formed by extensions beyond their vertical flange 36 of their single horizontal flange 37.

In the embodiment shown the two legs 31 are symmetrical relative to each other on either side of the median vertical axis M of the system. They are inclined to each other in a V-shape, approaching one another in the direction from the upper crossmember 32 towards the lower crossmember 33.

As shown, they are in practice at a distance from each end of each of the crossmembers 32, 33, defining between them a space 42.

As shown, the upper crossmember 32 preferably comprises a plurality of pairs of holes 34.

There are in this way four pairs of holes 34 aligned along the length of the crossmember 32, for example.

The holes 34 are in practice disposed so as to correspond in pairs to the installation dimension D of the sanitary apparatus 11 concerned.

The term installation dimension D is to be understood in this context, and as shown in FIG. 1, as referring to the distance between the holes in the lugs 12 of the sanitary apparatus 11.

Experience shows that four pairs of holes 34 are sufficient to cater for all installation dimensions D likely to be encountered.

Only the upper crossmember 32 comprises in this way holes 34 adapted for fixing a sanitary apparatus 11.

In line with each of the holes 34, projecting from the horizontal flange 37 of the crossmember 32, is a boss 43 adapted to limit the insertion into a hole 34 of the bolt 20 needed for this fixing.

In other words, the distance d between a boss 43 and the vertical flange 33 of the upper crossmember 32 is just sufficient to enable the insertion between the boss 43 and the vertical flange 36 of the nut 21 with which the corresponding bolt 20 is to cooperate screwthread-fashion, as schematically represented by the arrow Fl in FIG. 4.

In this way there is advantageously no need for any lock-nut for locking the bolt 20.

In the embodiment shown the thickness of the bosses 43 is less than the diameter of the corresponding holes 34.

In the embodiment shown the locating means that this support structure 30 incorporates comprise a cradle 45 disposed in the median part of the upper crossmember 32. As schematically represented in thinner outline in FIG. 1, the cradle is adapted to receive a clamp 46 adapted to fastening any kind of pipe or the like, in this instance the pipe 25.

In practice the cradle 45 is part of a flange 47 which projects from the horizontal flange 37 of the upper crossmember 32, along the edge of the latter opposite its vertical flange 36 and parallel to the vertical flange 36. In line with the flange 47 the latter comprises, in its median area, a notch 48 adapted to permit the pipe 25 to pass.

On either side of the cradle 45 the flange 47 carries two studs 49 for fixing the clamp 46.

The locating means that the support structure 30 incorporates further comprise two lugs 50 carried by its respective legs 31 and extending transversely relative to its median vertical axis M. For fastening any kind of pipe or the like, in this instance the pipe 26, each incorporates a hole 52 for fixing a ring formed by two clamps 54 as schematically represented in thinner outline in FIG. 1.

In practice the lugs 50 are substantially at mid-height between the crossmembers 32 and 33 and parallel to the latter, joining the two flanges 38, 39 of the leg 31 carrying them.

In the embodiment shown the hole 52 is an elongate slot perpendicular to the flange 38 of the legs 31 and therefore perpendicular to the mean general plane of the system.

In the embodiment shown the locating means that the support structure in accordance with the invention incorporates further comprise on each of the legs 31 at least one hole 55 adapted to permit any form of pipe or the like to pass through, in this instance the pipe 23.

In practice each of the legs 31 features in this way, side by side and at the same level on its vertical flange 38, two holes 55 each adapted to have a pipe 23 pass through it. The innermost of these holes 55, that is to say that nearer the median vertical axis M of the system, is formed in a lug 56 projecting locally from the leg 31 towards the median vertical axis M.

The locating means that the support structure 30 in accordance with the invention incorporates finally comprise a hole 58 in the median part of the lower crossmember 33, to be more precise in the median part of the horizontal flange 37 of the lower crossmember 33. It is adapted for fitting a ring 59 for fastening any form of pipe or the like, in this instance the pipe 24, as schematically represented in thinner or chain-dotted outline in FIGS. 1 and 2.

The ring 59 is carried by a stud 60 which passes through the hole 58 in the crossmember 33 and cooperates with nuts on either side of the latter. It is advantageously adjustable in height.

To enable the pipe 24 to pass in the lowest position of the ring 59 the flange 36 of the lower crossmember 33 has in its median area a notch 62 continuous with the space 42 formed between the legs 31 and the distance between the lugs 36 of the latter is made sufficiently large for the pipe 24 to be extended if necessary to the level of the lugs 56 for a higher position of the ring 59.

It will be noted that the axis of the holes 34 and 55 is perpendicular to the mean general plane of the system, and is therefore a horizontal axis.

On the other hand, the axis of the holes 52 and 58 is parallel to the mean general plane of the system, and is therefore a vertical axis.

Figure 8A:
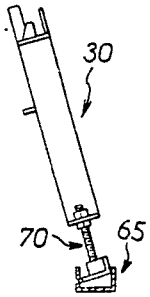
FIGS. 8A through 8C are views to a reduced scale, the first being a side view and the other two elevation views, showing successive phases in fitting the support structure in accordance with the invention.
Figure 8B:
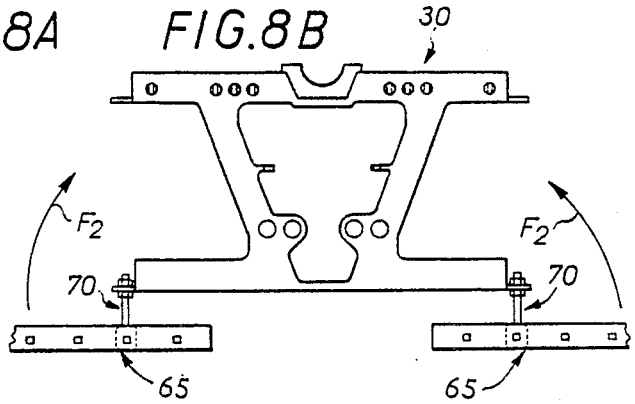
Figure 9:
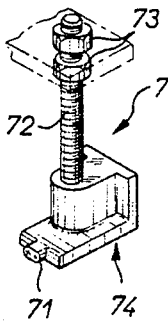
FIG. 9 is a partial view of the fitted support structure to a larger scale and in cross-section on the line IX—IX in FIG. 8C.
Figure 7:
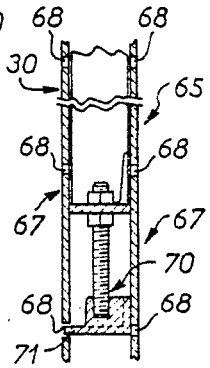
FIG. 7 is a perspective view to a larger scale of one of the cramps with which this support structure is equipped.

Two uprights 65 are associated with the support structure in accordance with the invention for fitting and holding it, as shown in FIGS. 8 through 10.

It will initially be assumed that these are special uprights separate from the uprights 13 of the framework 10.

Like the latter, they have a straight median part 66 and two lateral flanges 67 perpendicular thereto.

At least one of the lateral flanges 67 on each upright 65 comprises along its length a row of holes 68 forming a rack and therefore preferably disposed at regular intervals.

These are generally rectangular holes, for example.

In the embodiment shown in FIGS. 8 through 11 each of the lateral flanges 67 of an upright 65 comprises perforations 68 in this way, which has the advantage of making it possible to use an upright 65 on the right or on the left of the support structure 30, at will.

Figure 12:
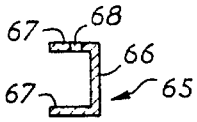
FIG. 12 is a view in transverse cross-section similar to that of FIG. 11 for an alternative embodiment of the upright.
Figure 14:
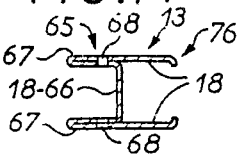
FIG. 14 is a view in transverse cross-section on the line XIV—XIV in FIG. 13 of one of the uprights corresponding to this alternative embodiment.

As an alternative to this, however, and as shown in FIG. 12, a single lateral flange 67 of the upright 65 may be formed with perforations 68 in this way, if required.

Be this as it may, the two uprights 65 associated in this way with the support structure 30 are adapted to be placed at respective ends of the crossmembers 32, 33 of the latter and their lateral flanges 67 are adapted to bracket these ends, each of which comprises a lug 40, as previously described.

For the purposes of engagement with the rack formed by the perforations 68 in at least one of the lateral flanges 67 of both uprights 65 each end of at least one of the crossmembers 32, 33 of the support structure 30 is equipped with a cramp 70 having a transversely projecting pin 71 adapted to be inserted into any of the perforations 68 of a rack.

In the embodiment shown it is the lower crossmember 33 which is equipped with cramps 70 in this way, by means of the lugs 40 formed by its ends. The hole 41 in each of the lugs 40 is adapted to fasten a cramp 70 of this kind.

Each of the cramps 70 with which the support structure in accordance with the invention is equipped in this way is preferably a screwjack.

In practice it comprises a threaded shank 72 by means of which it is adapted to be attached, adjustably, to the lower crossmember 33 concerned, by cooperating with two nuts 73 on respective sides of the hole 41 in the corresponding lug 40 of the latter and an attachment block 74 carried by said threaded shank 72 which conjointly features at its base the pin 71 whereby the system cooperates with the rack formed by the perforations 68 in the associated upright 65.

In the embodiment shown the attachment block 74 of a cramp 70 has an angle-iron profile on the outside, the pin 71 projecting from the median part of the edge of the horizontal flange of this angle-iron shape By way of its vertical flange, and therefore on the side opposite the pin 71, it is adapted to cooperate with the corresponding lateral flange 67 of the associated upright 65, against which it bears.

As previously outlined, the support structure 30 in accordance with the invention is fitted in two stages.

In the first stage (FIGS. 8A and 8B) the uprights 65 are laid flat on the floor, aligned with each other, and the support structure 30 is offered up to them slantwise (FIG. 8A). The attachment block 74 of each cramp 70 is inserted into the upright 65 until the pin 71 of the cramp 70 enters one of the perforations 68 in the corresponding upright 64. It is then straightened, vertically in the plane of the upright 65 (FIG. 8B).

Figure 8C:
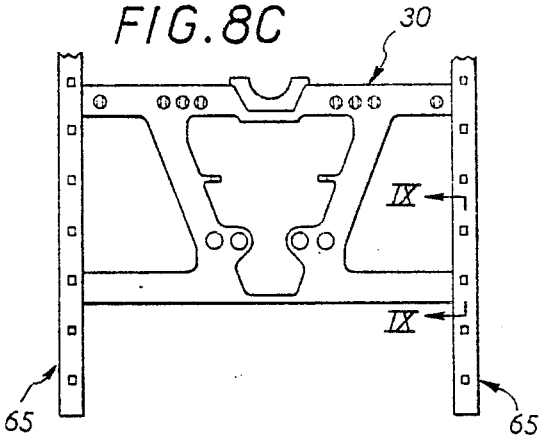

In the second stage the uprights 65 are swung to a vertical position about the pins 71 of the cramps 70 of the support structure 30, as shown by the arrows F2 in FIG. 8B, until their lateral flanges 67 engage over the ends of the crossmembers 32 and 33 of the support structure 30 (FIG. 8C).

In the same way as the uprights 13 of the framework 10, the uprights 65 carrying in this way the support structure 30 in accordance with the invention then have their base inserted into the bottom rail 16 laid on the floor 14, between two of said uprights 13.

The arrangements are such that they are then adjacent to these uprights 13 and may be attached to them by any appropriate means, for example by bolting them on.

All that is then necessary is to attach the sanitary apparatus 11 and the pipes or the like that serve it.

It will have been understood that by appropriately choosing the perforations 68 in the uprights 65 with which the cramps 70 of the support structure 30 are engaged and then by operating the screwjacks constituted by the cramps 70 it is possible, before the support structure 30 is fitted, to ensure that when it is fitted it is at an appropriate height for the sanitary apparatus 11 subsequently to be fixed to it.

In the foregoing, the uprights 65 are in an arrangement usually called a "seat" arrangement in France and extend over part only of the height of the uprights 13 of the framework 12, duplicating the latter locally at their lower end.

Figure 13:
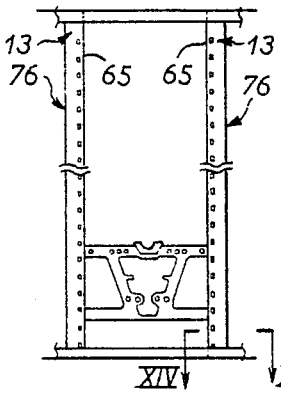
FIG. 13 is a view in elevation similar to that of FIG. 10 relating to an alternative embodiment of the support structure in accordance with the invention.

As an alternative to this (FIG. 13) they can also extend over the full height of the uprights 13 or even, as shown, be in one piece 76 with the latter.

In the embodiment shown the part 76 is folded to an H-shape and has on a first side the lateral flanges 18 of an upright 13 in a single thickness adapted to enable the cladding panels of the partition wall concerned to be screwed to it and, on the other side, continuously with the foregoing but with double the thickness to confer the necessary mechanical strength, the lateral flanges 67 of an upright 65.

As previously, at least one of the flanges 67 (each of them, for example) comprises spaced perforations 68 forming a rack and made by roller-stamping, for example.

Figure 15:
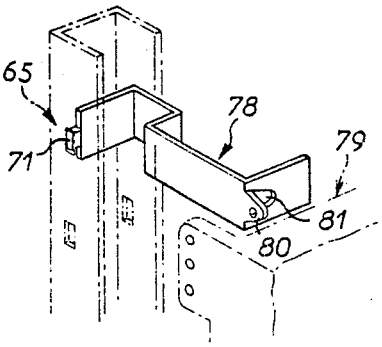
FIG. 15 is a perspective view of a bracket for fastening sanitary apparatus to an upright of this kind.

As shown in FIG. 15 the perforations 68 which at least one of the lateral flanges 67 of an upright 65 comprises in this way may also be used for attaching to the upright 65 a bracket 78 for fastening a cistern 79.

The bracket 78 has at one end, which is bent at right-angles to cooperate in bearing engagement with the lateral flanges 67 of an upright 65, a pin 71 adapted to be inserted into one of the perforations 68 in the upright.

At the other end, which is also bent at right-angles, it has along the corresponding edge a lug 80 adapted for attaching the cistern 79.

As shown here, the lug 80 is continuous with one of the flanges of the corresponding angle-iron shape and is formed, for example, by stamping it out from the other flange of the latter, leaving an aperture 81.

Of course, the present invention is not limited to the embodiments described and shown but encompasses any variant execution and/or implementation thereof.

Specifically, rather than being fitted to the lower crossmember of the support structure in accordance with the invention the cramps for attaching the support structure to the associated uprights may be fitted to the upper crossmember.

This is why a lug is also provided at each end of the latter.

What is claimed is:

1. A support structure for wall-mounted sanitary apparatus, comprising upper and lower crossmembers, two legs joining said upper and lower crossmembers in a one-piece construction, said upper crossmember having a plurality of pair of holes disposed symmetrically to each other on respective sides of a median vertical axis for fastening a sanitary apparatus, locating means for fastening to the support structure at a given location at least one pipe means for the sanitary apparatus, said legs being inclined relative to each other so as to define a generally V-shape, upper ends of said legs being spaced farther from each other than lower ends of said legs, and said upper and lower ends of said legs being inwardly spaced from free ends of the respective upper and lower crossmembers.

2. A support structure according to claim 1, wherein said holes in said upper crossmember are aligned along its length.

3. A support structure according to claim 1, wherein in line with each of the holes for fastening a sanitary apparatus is a boss adapted to limit the insertion of a bolt into the corresponding hole.

4. A support structure according to claim 1, wherein said locating means comprises a cradle disposed in the median part of said upper crossmember and adapted to receive a cramp for attaching pipe means.

5. A support structure according to claim 1, wherein the locating means comprises two lugs on the respective legs extending transversely relative to the median vertical axis, each of said lugs having a hole for fastening a ring defined by two clamp members adapted to attach pipe means.

6. A support structure according to claim 1, wherein said locating means comprises on each of said legs at least one hole adapted to be traversed by pipe means.

7. A support structure according to claim 6, wherein each of said legs comprises two holes, each 4 the last-mentioned holes being adapted to have pipe means extend therethrough.

8. A support structure according to claim 7, wherein the last-mentioned holes are at the same level relative to the median vertical axis of the support structure.

9. A support structure according to claim 8, wherein an innermost of the last-mentioned holes in a said leg is disposed in a lug projecting locally from said last-mentioned leg towards the median vertical axis of the support structure.

10. A support structure according to claim 1, wherein said locating means comprises a hole in a median part of said lower crossmember and adapted for fitting a ring for attaching pipe means.

11. A support structure according to claim 1, wherein said crossmembers are of the same length.

12. A support structure for wall-mounted sanitary apparatus, comprising upper and lower crossmembers, two legs joining said upper and lower crossmembers in a one-piece construction, said upper crossmember having a plurality of pair of holes disposed symmetrically to each other on respective sides of a median vertical axis for fastening a sanitary apparatus, locating means for fastening to the support structure at a gain location at least one pipe means for the sanitary apparatus, and further comprising two uprights disposed at respective free ends of said crossmembers for holding the same, each of said uprights comprising two flanges adapted to receive the ends of said upper and lower crossmembers, one of said flanges of each of said uprights having along its length a row of perforations defining a rack means, each end of one of said crossmembers being equipped with a cramp having a transversely projecting protrusion cooperable with a selected one of said perforations for location the support structure at a desired position along said uprights.

13. A support structure according to claim 12, wherein a side of each of said cramps opposite the protrusion is cooperable in bearing engagement with the corresponding flange of the associated upright.

14. A support structure according to claim 13, wherein each of said cramps comprises a screwjack.

15. A support structure according to claim 14, wherein each of said cramps comprises a threaded shank cooperable with the associated crossmember so as to be adjustable in position, and an attachment block carried by said threaded shank and which in turn incorporates the protrusion cooperable with a selected one of the perforations.

16. A support structure according to claim 12, wherein each end of said crossmembers fitted with a cramp forms a lug including a hole for attaching a said cramp.

* * * * *